United States Patent [19]

Nash

[11] Patent Number: 4,964,273

[45] Date of Patent: Oct. 23, 1990

[54] SUBPLATE-MOUNTED CONTROL VALVES IN CONVERTIBLE OSCILLATOR DRIVE SYSTEM

[75] Inventor: John V. Nash, Boundstone, England

[73] Assignee: Kinetrol Limited of Trading Estate, Farnham, United Kingdom

[21] Appl. No.: 257,069

[22] Filed: Oct. 13, 1988

[30] Foreign Application Priority Data

Oct. 14, 1987 [GB] United Kingdom ..... 87 24066

[51] Int. Cl.[5] ..... F01C 9/00; F04B 39/12; F15B 13/044; F15B 15/26

[52] U.S. Cl. ..... 60/325; 91/54; 91/440; 91/462; 91/464; 92/59; 92/121; 92/163; 137/519.5; 137/884; 417/299; 417/424.1

[58] Field of Search ..... 92/59, 130 C, 121, 145, 92/163; 60/431, 432; 137/519.5, 884; 417/299, 410, 424.1; 91/54, 177, 211, 440, 464

[56] References Cited

U.S. PATENT DOCUMENTS

| | | | |
|---|---|---|---|
| 2,467,508 | 4/1949 | Trautman | 60/432 X |
| 2,672,731 | 3/1954 | Ashton | 60/432 X |
| 3,233,523 | 2/1966 | Passaggio | 92/59 X |
| 3,348,764 | 10/1967 | Romerhaus | 417/299 X |
| 3,456,442 | 7/1969 | Brooks | 417/299 X |
| 3,704,588 | 12/1972 | Trabbic | 417/299 X |
| 3,773,074 | 11/1973 | Miceli | 137/596 |
| 3,818,800 | 6/1974 | Bertaux | 92/163 X |
| 4,170,214 | 10/1979 | Gill et al. | 137/884 X |
| 4,325,678 | 4/1982 | Kanamaru et al. | 417/424.1 X |
| 4,333,391 | 6/1982 | Nash | 92/121 |
| 4,377,183 | 3/1983 | Johansson et al. | 137/884 X |
| 4,723,576 | 2/1988 | Raymond | 137/884 |
| 4,727,899 | 3/1988 | Massey et al. | 137/884 X |
| 4,770,209 | 9/1988 | Neff | 137/884 |

FOREIGN PATENT DOCUMENTS

| | | | |
|---|---|---|---|
| 2151298 | 5/1973 | Fed. Rep. of Germany | 92/121 |
| 1059285 | 12/1983 | U.S.S.R. | 137/884 |
| 678485 | 3/1952 | United Kingdom . | |
| 1022816 | 3/1966 | United Kingdom . | |
| 1053436 | 1/1967 | United Kingdom . | |
| 1325201 | 1/1973 | United Kingdom . | |
| 1548584 | 7/1979 | United Kingdom . | |

*Primary Examiner*—Edward K. Look
*Assistant Examiner*—George Kapsalas
*Attorney, Agent, or Firm*—Hopgood, Calimafde, Kalil, Blaustein & Judlowe

[57] ABSTRACT

A fluid-operated actuator (2) is connected to a pumping unit (12) through a control unit (10) in which are mounted control valves (30,32) for regulating the movements of the actuator. The control valves communicate with the actuator and the pumping unit through conduits in replaceable adaptor plates (**60*a*,60*b*,60*c***). By changing the adaptor plates, different operating modes of the actuator can be selected. The pumping unit is carried on the control unit through a rotationally adjustable connection to permit it to be mounted upright although the orientation of the actuator and control unit may vary.

16 Claims, 5 Drawing Sheets

FIG. 2.
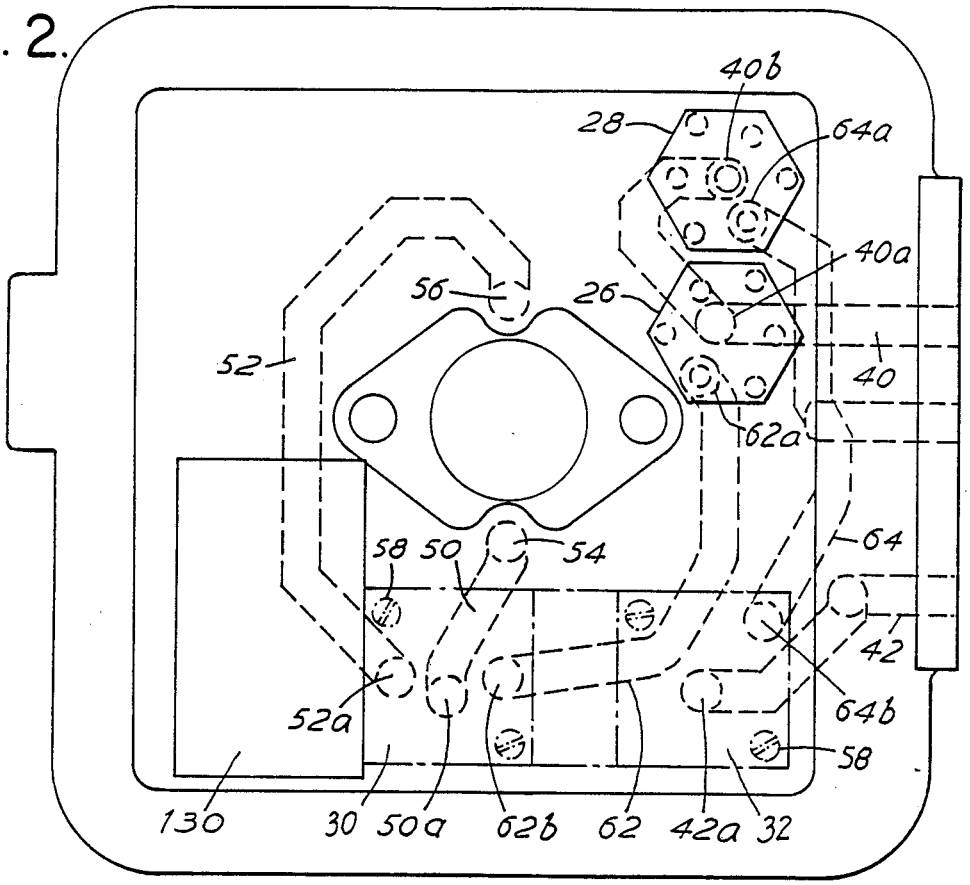
FIG. 2c.
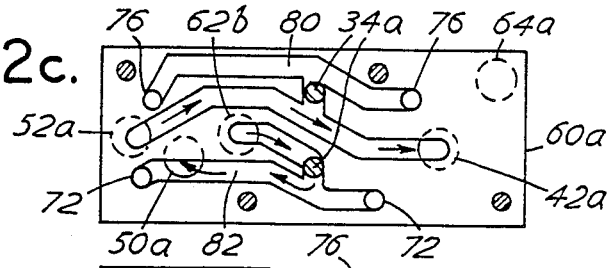
FIG. 2a.
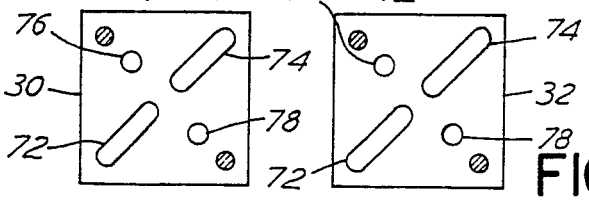
FIG. 2b.

SUBPLATE-MOUNTED CONTROL VALVES IN CONVERTIBLE OSCILLATOR DRIVE SYSTEM

FIELD OF THE INVENTION

This invention relates to means for the control of fluid-powered actuators.

Such actuators have a wide range of applications in many fields. In the interests of economy in the manufacture and stocking of parts, it is desirable to standardise many of their features. However, this is not easy as regards the control apparatus for actuators. The same actuator design may be employed in a variety of different modes, each of which requires a different control set-up. There can also be problems from the fact that it may be necessary to install an actuator in any of a number of different orientations, which can also require different configurations of the control set-up.

SUMMARY OF THE INVENTION

The present invention has an object of providing an actuator control apparatus so arranged that it is possible to reduce the number of components that would be required to provide a series of different control set-ups.

According to one aspect of the invention, there is provided a control means for a fluid-operated actuator comprising a control unit having fluid supply connection means and porting for connection to porting of the actuator for the flow of a fluid from said connection means to operate the actuator, valve means for controlling said flow of fluid, at least one separate adaptor device mounted in the unit having a plurality of conduits for interconnection of said fluid supply connection means to the operating porting via said valve means.

In such an arrangement, by having a number of different adaptor devices providing different patterns of interconnection between the source and the actuator under the control of the valve means, it is possible for the greater part of the control unit to be used unaltered for different modes of control, the chosen mode requiring only the fitting of the appropriate adaptor device or devices.

For many forms of fluid powered control means, operation in a particular orientation may be desirable or essential. For example, if there is a motor-driven hydraulic pump, it may be important to keep the pump below its driving member in order to ensure that the motor cannot be affected by leakage from the pump. This also is a reason for multiplication of the versions of a particular form of control means.

According to another aspect of the invention, a control means for a fluid-operated actuator comprises a fluid power source and a control unit for attachment to the actuator to connect with an operating mechanism of the actuator, the fluid power source being provided by a pumping unit and being attached t the control unit by means securing said units together releasably, the two units having porting that is put in communication when they are secured together, said porting comprising a plurality of concentrically disposed openings on at least one of the units and said securing means being adapted to attach the units together in a plurality of different angular positions with respect to the common centre of said openings, thereby to permit selection of the relative orientation of the two units attached together, said porting comprising a plurality of concentrically disposed openings on at least one of the units and said securing means being adapted to attach the units together in a plurality of different angular positions with respect to the common centre of the said openings, thereby to permit selection of the relative orientation of the two units.

It is of course possible within the scope of the invention to provide an apparatus with both the interchangeable adaptor device and the variable means of connection set out above.

By way of example an embodiment of the invention will be described in more detail with reference to the accompanying drawings.

BRIEF DESCRIPTION OF THE DRAWINGS

FIGS. 2 to 4 are plan views illustrating the fluid connections within the control unit of FIG. 1 for three different modes of operation of the actuator, FIGS. 2*a*, 2*b* and 2*c* are separate plan views, which respectively show porting to each of two valves and to a first adaptor plate for operatively determining coupling between ports of the two valves, for the mode of operation of FIG. 2, FIGS. 3*a*, 3*b* and 3*c* are separate plan views, similar to FIGS. 2*a*, 2*b* and 2*c* but involving at FIG. 3*c* a second adaptor plate for operatively determining coupling between ports of the two valves, for the mode of operation of FIG. 3, FIGS. 4*a*, 4*b* and 4*c* are separate plan views, similar to FIGS. 2*a*, 2*b* and 2*c* but involving at FIG. 4*c* a third adaptor plate for operatively determining coupling between ports of the two valves, for the mode of operation of FIG. 4, FIGS. 5 and 6 are end views of the control unit and the pumping unit of the control means showing the mating faces through which they are secured together.

DESCRIPTION OF THE PREFERRED EMBODIMENT

Figure 1:
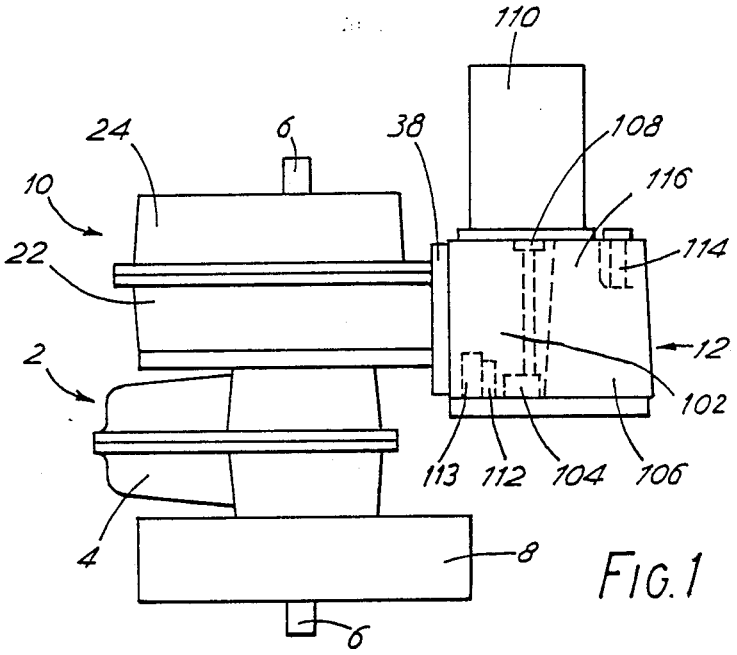
FIG. 1 is an outline front view of a fluid-powered actuator provided with control means according to the invention.

FIG. 1 illustrates a swinging vane actuator 2 of conventional construction, having a main casing 4 the interior of which is divided into mutually sealed chambers by a vane (not shown) pivoting on a shaft 6 through angular movement of perhaps 90° by the application of fluid pressure to one or other of the chambers, the actuator thereby operating a device such as a valve (not shown) connected to the shaft. FIG. 1 also shows an optional return spring unit 8 which biases the actuator shaft 6 to one end position. An example of this form of actuator is described in more detail in GB 1270941. Mounted on the top of the actuator casing is a control unit 10 which has bolted to it a pumping unit 12 supplying, through the control unit, pressure fluid for driving the actuator.

The control unit comprises a dished casing 22 and a cover 24 which together provide an enclosed chamber in which a series of control devices for the fluid flows are mounted. These devices include first and second non-return valves 26,28, first and second solenoid-operated valves 30,32, flow control screws 34, as well as such electrical control means as limit switches and positioning means (not shown) comprising an electronic positioner circuit of a kind known in the art. The solenoid-operated valves may be proprietary units such as Webber 18-series sub-base mounted valves, 3/2 normally open type. The casing has a mounting flange 38 for the pumping unit 12. Inlet and return conduits 40,42 in the casing walls open into the flange 38 and communicate directly with corresponding conduits 44,46 opening into mounting face 48 of the pumping unit that seats against the flange 38. Under the control of the devices in the control unit, as will be described below, fluid can flow between the inlet and return conduits 40,42 and a further pair of conduits 50,52 in the casing bottom wall that connect with respective openings 54,56 in the casing bottom face communicating directly with the two sealed chambers of the actuator on opposite sides of the swinging vane, so as to drive the actuator.

The heads of screws 58 bear on the bases of the valves 30,32 and the screws are threaded into the casing bottom wall to secure the valves in position over a region of the casing floor into which the conduits 42,50,52,62,64 open. The fluid flow in the control unit between the inlet and return conduits 40,42 and the conduits 50,52 connected to the actuator is channelled through a replaceable adaptor plate 60 which is sandwiched by the screws 58 between the solenoid-operated valves 30,32 and the casing interior floor over the conduits 42,50,52,62,64. The adaptor plate has internal conduits that determine how the casing conduits communicate with inlet and outlet porting in the bases of the valves.

More specifically, the pressure inlet conduit 40 communicating with the pumping unit extends to ports **40*a*,40*b* that open onto the inlets of the two non-return valves 26,28. From outlet 62*a* of the first non-return valve a conduit 62 extends through the casing to a port 62*b* within the area of the adaptor plate and below the first valve 30, while a conduit 64 similarly connects the outlet 64*a* from the second non-return valve 28 to a port 64*b* within the area of the adaptor plate below the second valve. The return conduit 42 to the pumping unit leads from a port 42*a* within the area of the adaptor plate under the second valve 32. The conduits 50,52 to the actuator porting 54,56 run from respective ports 50*a* and 52*a*** in the area of the adaptor plate under the second valve.

The base of each solenoid-operated valve 30,32 has corresponding porting consisting of two elongate ports 72,74 extending along a common diagonal and, on opposite sides of that diagonal a further pair of ports 76,78. In each valve the internal passages are so arranged that, when its solenoid is energised, the elongate port 74 communicates with both smaller ports 76,78 and the other elongate port 72 is isolated, whereas when the solenoid is de-energised, the other elongate port 72 communicates with both smaller ports 76,78 and the elongate port 74 is isolated. The porting in the bases of the valves 30,32 communicates with the internal conduits in the adaptor plate 60. The configuration of these conduits accordingly determines the fluid circuit connections to and from the solenoid-operated valves and the actuator. Three particular cases with alternative adaptor plates will now be described.

In the first arrangement, illustrated in FIG. 2, the actuator vane is driven clockwise (as seen in the figure) by fluid pressure but returns in the anti-clockwise direction under the action of the return spring unit 8. For clarity, the conduits in the adaptor plate **60*a* used in this mode, and the porting of the valves 30,32** are shown separately, but the associated openings of the casing conduits and the operative valve porting are indicated on the adaptor plate plan. For simplicity, the sealing elements between the valve porting, the adaptor plate conduits and the casing openings are not shown in the drawings.

The adaptor plate **60*a* contains two internal branched conduits 80,82, the branches of the first connecting with the casing ports 42*a*,52*a* and respective ports 76 of the first and second valves 30,32. The second adaptor plate conduit 82 communicates with the ports 50*a*,62*b* in the casing, and the ports 72 of both solenoid valves. When driving the vane clockwise, the valve solenoids are energised and there is no flow through the valves. The arrows indicate the flows that occur in this state. Inlet pressure is applied, through the first non-return valve 26, the casing conduit 62 and the second adaptor plate conduit 82 to the port 50*a*, the conduit 50 and thus to the actuator. The conduit 52 to the other actuator port is connected through the first conduit 80 of the adaptor plate to the port 42*a* in the casing, and thus directly to the return conduit 42. Accordingly, pressurised fluid flows into the actuator to turn the vane clockwise as the fluid on the other side of the vane flows to the return line 44** in the pumping unit.

For anti-clockwise movement, the fluid pump is stopped and both valve solenoids are de-energised, which opens them to flow. Driven by the force of the actuator spring, fluid returns through the conduit 50 and conduit 82, through ports 72,76 of the now open solenoid valves, and so into the first conduit 80. The conduit 80, however, is still connected to the actuator supply conduit 52 and so allows the fluid forced out of the conduit 50 to pass to the other side of the vane.

Figure 3:
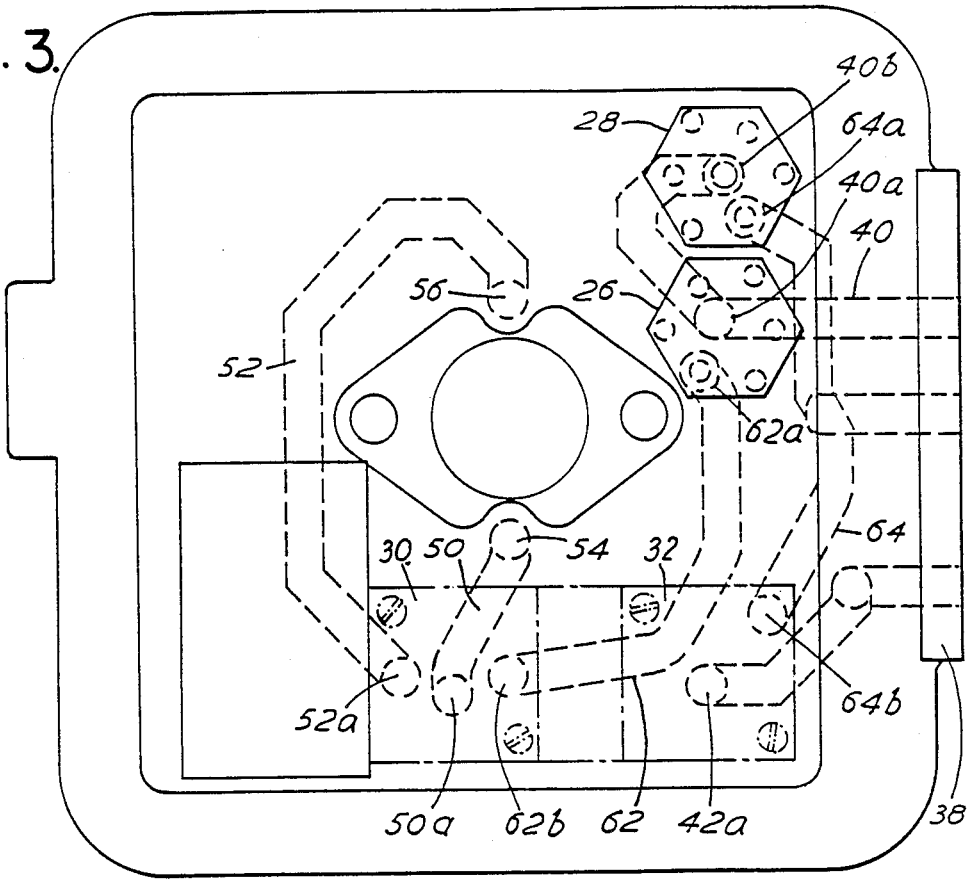
Figure 3C:
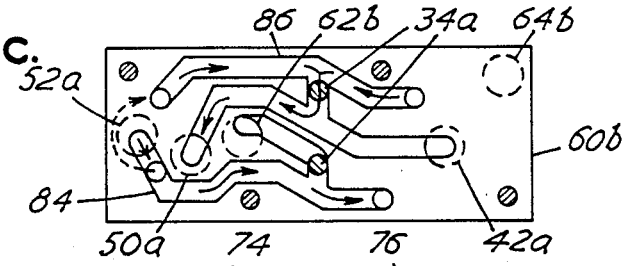
Figure 3A:
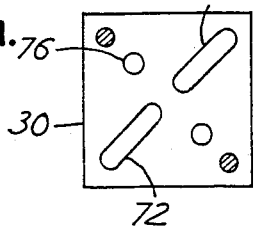
Figure 3B:
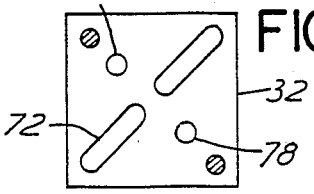

In the second case, illustrated in FIG. 3, in a similar manner to FIG. 2, the actuator spring urges the vane clockwise (as seen in the figure) and anti-clockwise movement is produced by the fluid pressure. The alternative adaptor plate **60*b* for this mode of operation has first and second conduits 84,86. The arrowed flows indicated in the figure are those occurring in the return movement, i.e., with the return spring driving actuator vane, the pump motor being off and both solenoid valves de-energized and open so there is open connection in each between port 72 and ports 76,78**.

In this condition fluid passes through the conduit 52 from the contracting actuator chamber along a path consisting of the adaptor plate first conduit 84, parallel routes through the first and second solenoid valves (via ports 72,76 in each) to the second adaptor plate conduit 86. The conduit 86 is connected to the actuator conduit 50 so that there is a direct transfer of fluid from the contracting chamber to the expanding one. When, conversely, the pump is driven and both solenoid valves are energised, the two adaptor plate conduits are no longer directly linked together. The first conduit 84 receives pressurised fluid through the conduit 62 from the first non-return valve 26 and channels it into the actuator conduit 52. There is no longer a connection through either of the solenoid valves to the second adaptor plate conduit 86 but that conduit is still connected between the actuator conduit 50 and the return line 42.

Figure 4:
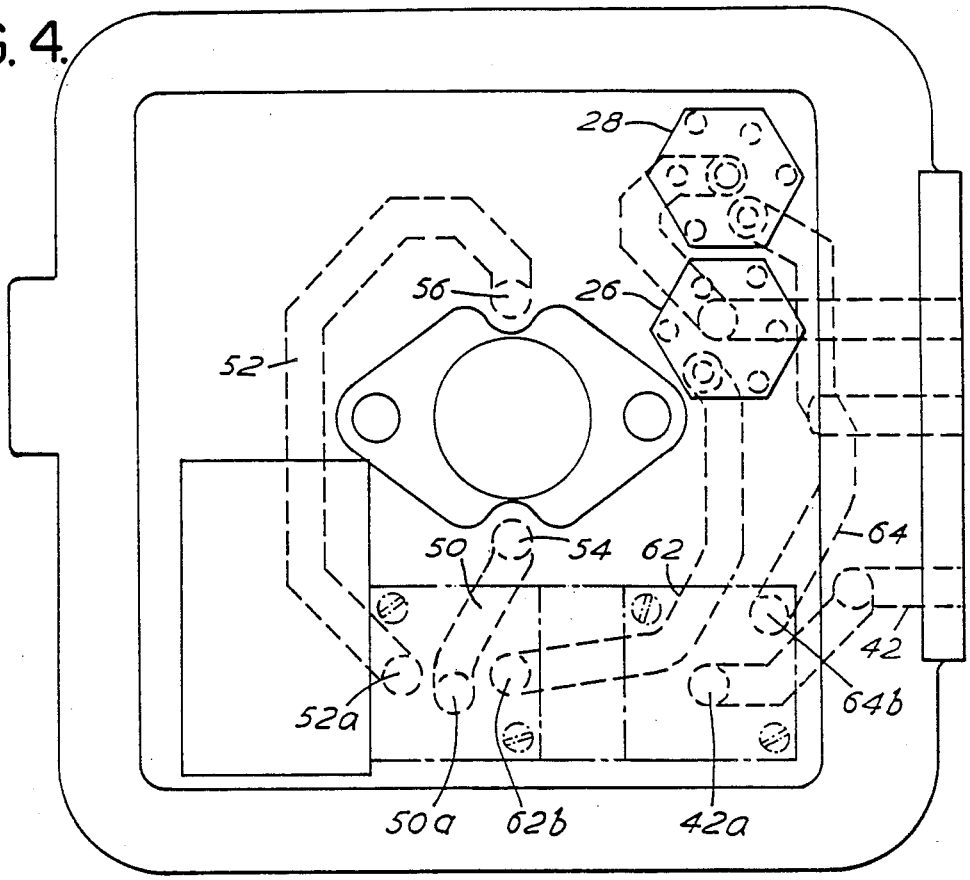
Figure 4C:
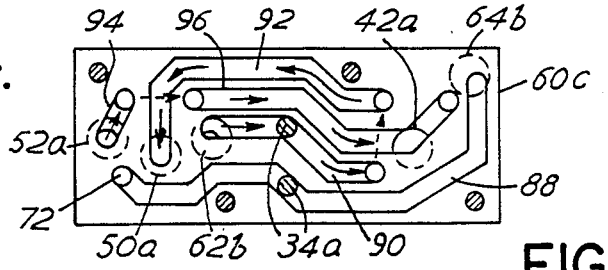
Figure 4A:
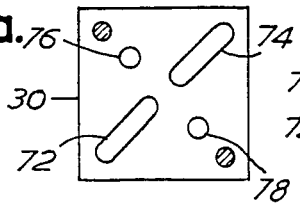
Figure 4B:
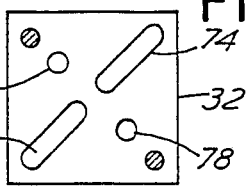

In the third example, shown in a similar manner in FIG. 4, the control unit is in a form that can drive the actuator vane in either direction, ie. the actuator has no spring return mechanism, and can lock the vane at any position in its travel. The adaptor plate 60c has five internal conduits, 88, 90, 92, 94, 96 and the arrowed flows indicate the condition in which the vane is being driven clockwise.

In this state, the first solenoid valve 30 is energised and solenoid valve 32 is de-energized. Pressurised fluid is applied to the conduit 88 from the supply conduit 64 from the second non-return valve 28 but because the conduit 88 leads to port 72 of the energized valve 30 there is no exit from the conduit. Pressurised fluid is also supplied through the supply conduit 62 to the conduit 90 in the adaptor plate and this can flow through ports 72,76 of the de-energized second solenoid valve 32 to adaptor plate conduit 92 that is in communication with actuator conduit 50. From the other side of the actuator vane, conduit 52 communicates with conduit 94 in the adaptor plate which, via ports 76,74 of the energised solenoid valve 30, is connected to adaptor plate conduit 96 that runs to the return conduit 42 so that fluid from the contracting actuator chamber can escape to the pump reservoir.

To reverse the movement of the vane, solenoid 30 is de-energized and solenoid 32 is energized. The supply conduit 64 and the actuator conduit 52 are now connected, through the adaptor plate conduit 88, the ports 72,76 of the first solenoid valve 30 and the adaptor plate conduit 94. The actuator conduit 50, on the other hand, is connected through the adaptor plate conduit 92 to the return conduit 42 via the ports 76,74 of the energised first solenoid valve.

It is to be noted that, in this last mode of operation, the return flow from either side of the actuator vane relies upon the energisation of one or other of the solenoid valves 30,32. If both valves are de-energized at the same time, the actuator is isolated from the return line and flow is blocked in both directions by the non-return valves 26,28 so the actuator vane is locked in position. This allows the control unit to regulate the movement of the vane so as to hold it at any desired point between its end positions, and also gives failsafe locking in the event of power failure. If the user requires free movement in the event of power failure, however, this can be achieved by removing the solenoid valves and replacing them rotated through 180°; here, as in the configuration already described, operation of the actuator is achieved by energising one solenoid valve and de-energising the other.

Figure 5:
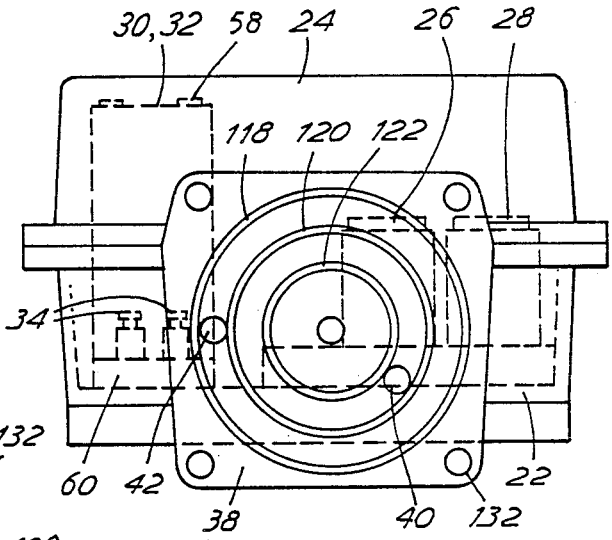

In each case, control of the flow rate can be obtained by the use of adjustable flow control screws 34 (FIG. 5). Each screw is held in a threaded boss on the respective adaptor plate, between the valves, and its tip 34*a* (FIGS. 2–4) projects into the pressure supply conduit in the adaptor plate to act as a variable restrictor for that conduit. In each of the illustrated cases of FIGS. 2 to 4, two flow control screws are indicated for the respective directions of motion, so that the rate of movement can be controlled independently in each direction.

The pumping unit 12 comprises a pump section 102, in which is located a gear pump 104 producing a supply pressure of about 10 bar, and a reservoir section 106 for the hydraulic fluid. The pump is driven, through a dog coupling 108, by an electric motor 110 mounted on top of the unit casing. Within the pump section of the pumping casing there is also shown a pressure release valve 112 connected between the pump pressure outlet line and the reservoir. This section also contains a delay valve 113, shown in more detail in FIGS. 8 and 9, connected to the outlet line which allows the motor to accelerate to high speed before full hydraulic pressure is generated, this providing a load characteristic more suited to an induction motor. The filler 114 of the pumping unit reservoir is so arranged that there is also an air space 116 left in the top of the reservoir which can be vented through a conventional fluid trap and filter (not shown) in the casing of the motor 110.

Figure 6:
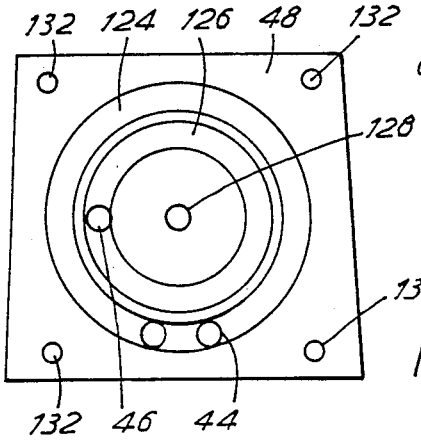

FIGS. 5 and 6 illustrate the connections between the control and pumping units. For these connections the control unit mounting flange 38 carries a series of three concentric O-rings 118,120,122. The sealing rings bear against the mating face 48 of the pumping unit casing in which there are two circular grooves 124,126 concentric with the O-rings, which seal the grooves from each other and from the centre and outermost regions of the mating faces. Opening into the inner of the two grooves in the pump casing face is the pressure line 46 from the pump 104. The fluid return line 44 to the reservoir section 106 leads from a pair of openings in the outer of the grooves, this arrangement with its two openings providing for a symmetrical flow from the pressure release valve 112 when it is opened, to avoid disturbing the operation of that valve. At the centre of the face 48 within the area sealed by the innermost O-ring 122, there is a passage 128 for electrical power supply leads (not shown) to the pump. Ancillary electrical equipment associated with the pump, such as a capacitor 130 (if a single phase induction motor is used) and a control circuit (not shown) can be located in the control unit through which the power supply leads pass. The control and pumping units are secured together by bolts through four bores 132 equally spaced along a circular locus concentric with the grooves 124,126. The pumping unit can, therefore, be secured in place in any of four rotational positions of adjustment to obtain the connections described.

The positioning of the motor 110 above the pump and reservoir ensures that hydraulic fluid will not seep into the motor by gravity. If in a particular installation the actuator axis is required to be horizontal rather than vertical as shown in FIG. 1, the construction of the connection between the control and pumping units allows the pumping unit still to be secured with its orientation unchanged so that the advantage of placing the motor uppermost can be retained.

Figure 7:
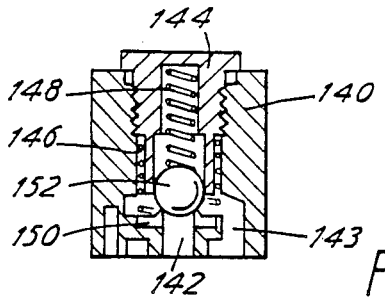
FIG. 7 illustrates one of the non-return valves in the control unit.

A preferred construction for the non-return valves 26,28 is illustrated in FIG. 7. The valve body 140 has a central inlet 142 and an outlet 143 radially offset, and is secured in place by a series of bolts inserted through the control unit casing from below. A threaded cap 144 encloses the main bore of the body and bears on two biasing springs 146,148, the first holding down a valve seat 150 surrounding the top of the inlet opening and the other urging a valve ball 152 against that seat if there is not a positive pressure difference between the inlet and outlet of the valve. It may be noted that in the first two modes of operation described above, where spring-return actuators are employed, biased to one end position, only one of the non-return valves carries a flow of fluid and in such cases it is possible to dispense with the other valve and blank off its mating ports in the casing.

Figure 8:
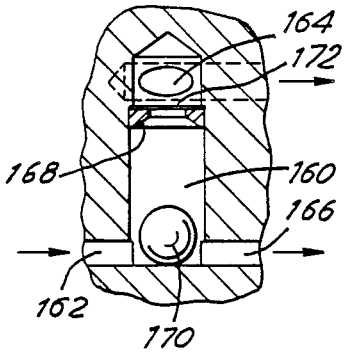
FIG. 8 illustrates the delay valve of the pump unit.
Figure 9:
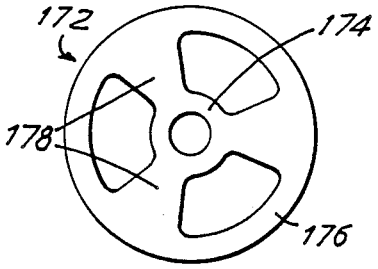
FIG. 9 is a plan view of the spring plate of the delay valve of FIG. 8.

The delay valve 113 of the pump section, as shown in FIGS. 8 and 9 comprises a chamber 160 having ports 162,164 communicating directly with the pump output side and the pump return side respectively and a further port 166 to the pressure release valve 112. The chamber has a valve seat 168 against which a valve ball 170 can seal to block flow from the port 162 to the port 164. At start-up, before the flow rate from the pump picks up, the ball rests at the bottom of the chamber and the initial outlet flow is therefore bypassed to the reservoir on the pump return side, via the port 164, so that there is a minimal load on the pump motor. As the flow upwards through the chamber increases it lifts the valve ball 170 until the ball reaches its seat 168 and is then held in sealing engagement with the seat by the static fluid pressure in the chamber. The pump outlet flow can now only be bypassed to the reservoir via the pressure release valve 112 and it therefore flows at normal operating pressure to the control unit.

When the pump is stopped, to ensure that any residual pressure in the chamber does not retain the valve ball sealed against its seating, a spring plate 172 is provided comprising a centre ring 174 connected to an outer rim 176 through radial arms 178. The spring plate is formed with a monostable action in which the centre ring is in a lower position from which it is forced upwards by the valve ball as it reaches the seat 168. While the ball is pressed against the seat the spring plate exerts a downwards pressure on it which is sufficient to dislodge the ball from the seat when the pump is stopped and the pressure on its output side drops.

I claim:

1. Control means for a fluid-operated actuator having actuator porting for the admission of pressure fluid, said means comprising:

(a) a control unit, (b) fluid supply connection means in said control unit, (c) operating porting on said unit for connection with the actuator porting for a flow of fluid from said supply connection means to operate the actuator, (d) said unit having an adaptor mounting face into which said operating porting opens, (e) valve means comprising a plurality of similar power-operated valves in the control unit for controlling said flow of fluid from the supply connection means, (f) said valves each having a mounting face and a series of fluid ports in said face, (g) a plurality of adaptor devices having (i) a pair of mating faces and (ii) a plurality of conduits extending between and opening into said mating faces, (h) said adaptor devices each having a different arrangement of said conduits and each said device being selectively and alternatively assembled with said control unit and valve means, (i) means for detachably securing a selected one of said adaptor devices to the control unit with one of said mating faces against the adaptor-mounting face of the unit to place operating porting in communication with the porting in said one mating face, and (j) means for attaching said valves to the selected adaptor device with their mounting faces against the other of said mating faces of the selected adaptor device to place said valve ports in communication with the conduits of the adaptor device, whereby a pattern of connection between the operating porting and valve fluid ports is determined by the selection of the adaptor device so as to provide alternative forms of control for said actuator.

2. Control means according to claim 1, wherein said valve means comprise two 3/2 solenoid valves for providing, in dependence upon the selected adaptor device, alternative modes of operation of said fluid-operated actuator in the form of an oscillatory movement actuator, from the group of said modes consisting of:

(i) single-acting power stroke in a first direction, (ii) single-acting power stroke in a direction opposite to said first direction, (iii) double-acting, fail-locked (iv) double-acting, fail-free.

3. Control means according to claim 1 wherein flow rate control means for said flow of fluid are carried by said at least one adaptor device.

4. Control means according to claim 1 wherein non-return valve means are provided in the control unit disposed in the path of fluid flow connection means to said at least one adaptor device.

5. Control means according to claim 1 for use with an actuator having opposite, mutually sealed spaces for operating fluid and which is biased to one end position in which one of the said spaces has expanded to a maximum and its opposite space has contracted to a minimum, and wherein said conduits of the at least one adaptor element together with the said valve means provide a connection for a fluid path between said opposite spaces of the actuator whereby, as the actuator moves under its bias to said one end position, fluid is transferred through said adaptor element conduits and the said valve means from the contracting space of the actuator to its opposite expanding space.

6. Control means according to claim 1 wherein said valve means have a selectable setting in which the operating porting for connection with the actuator is isolated so as to lock the actuator fixed.

7. Control means according to claim 1 wherein the valve means comprise two control valves for the interconnection of the fluid supply connection means with the actuator porting, the respective valves being alternatively actuated for opposite directions of movement of the actuator.

8. Control means according to claim 6, wherein said valve means comprises two solenoid-operated valves for the interconnection of the fluid-supply connection means with the actuator porting, and de-energization of each valve individually blocking flow from the actuator in a respective one of said two opposite directions of movement of the actuator, whereby de-energization of both valves fixedly locks the actuator.

9. Control means for a fluid-operated actuator having porting for the admission of pressure fluid to the actuator, said apparatus comprising a fluid power source for the actuator and a control unit for attachment to the actuator to connect said power source to the actuator porting, a pumping unit containing the fluid power source, attachment means securing said control and pumping units together releasably, fluid porting in each of said two units, said porting of the respective units being put in communication when the units are secured together by said securing means, said porting comprising a plurality of concentrically disposed openings on at least one of the units, and said securing means being formed for attachment of the units together in a plurality of different angular positions with respect to the centre of concentricity of said openings, thereby to permit selection of the relative orientation of the two units.

10. Control means for a fluid-operated actuator having porting for the admission of pressure fluid to the actuator, said apparatus comprising a fluid power source for the actuator and a control unit for attachment to the actuator to connect said power source to the actuator porting, a pumping unit containing the fluid power source, attachment means securing said control and pumping units together releasably, fluid porting in each of said two units, and comprising inlet and outlet connections in said pumping unit for a circulatory flow of pumped liquid through said units, said porting of the respective units being put in communication when the units are secured together by said securing means, said porting comprising a plurality of concentrically disposed openings on at least one of the units, and said securing means being formed for attachment of the units together in a plurality of different angular positions with respect to the centre of concentricity of said openings, thereby to permit selection of the relative orientation of the two units, and sealing means between said inlet and outlet connections, said sealing means being operative in each of the different angular positions of attachment for preventing bypass of the control unit.

11. Control means according to claim 9 or claim 10, wherein the securing means between the pumping and control units provide four alternative relative positions of rotation at which the units may be secured together at 90° intervals of rotation about said centre of concentricity.

12. Control means according to claim 9 or claim 10, wherein conduits in both said units open at said centre of concentricity for receiving electrical leads extending between the units.

13. Control means according to claim 9 or claim 10, wherein the pumping unit comprises a pump and an electrical motor arranged for disposition with the pump below the motor, said releasable securing means permitting said disposition to be maintained with a plurality of different orientations of the control unit on the fluid-operated actuator.

14. Control means according to claim 9 or claim 10, wherein the pumping unit comprises a pump and an electrical motor arranged for disposition with the pump below the motor, said releasable securing means permitting the said disposition to be maintained with a plurality of different orientations of the control unit on the fluid-operated actuator, and pressure-limiting means for limiting the pump outlet pressure on start-up, said pressure-limiting means comprising a bypass passage, and flow-responsive means responsive to the rate of flow from the pump to block said bypass passage with increase of flow rate after start-up.

15. Control means according to claim 9 or claim 10, wherein the pumping unit comprises a pump and an electrical motor arranged for disposition with the pump below the motor, said releasable securing means permitting the said disposition to be maintained with a plurality of different orientations of the control unit on the fluid-operated actuator, pressure-limiting means for limiting the pump outlet pressure on start-up, said pressure-limiting means comprising a bypass passage, and flow-responsive means responsive to the rate of flow from the pump to block said bypass passage with increase of flow rate after start-up, said blocking means being maintained in its operative blocking position by the pump outlet pressure during continuing operation of the pump.

16. Control means according to claim 9 or claim 10, wherein the pumping unit comprises a pump and an electrical motor arranged for disposition with the pump below the motor, said releasable securing means permitting the said disposition to be maintained with a plurality of different orientations of the control unit on the fluid-operated actuator, pressure-limiting means for limiting the pump outlet pressure on start-up, said pressure-limiting means comprising a bypass passage, and flow-responsive means responsive to the rate of flow from the pump to block said bypass passage with increase of flow rate after start-up, said blocking means being maintained in its operative blocking position by the pump outlet pressure during continuing operation of the pump, said pressure-limiting means further comprising biasing means acting on the blocking means for urging it away from its operative positions, whereby to reopen the bypass when the pump outlet pressure falls below a predetermined level.

* * * * *